US006083571A

United States Patent [19]

Kapfinger

[11] Patent Number: 6,083,571

[45] Date of Patent: Jul. 4, 2000

[54] METHOD OF APPLYING A PATTERN TO A SURFACE OF A SUBSTRATE

[75] Inventor: Harald Kapfinger, Kirchbichl, Austria

[73] Assignee: Schablonentechnik Kufstein Aktiengesellschaft, Kufstein, Austria

[21] Appl. No.: 09/272,254

[22] Filed: Mar. 19, 1999

[30] Foreign Application Priority Data

Mar. 19, 1998 [EP] European Pat. Off. ..... 98105042

[51] Int. Cl.[7] ..... B05D 1/40

[52] U.S. Cl. ..... 427/555; 427/596; 427/286; 427/424; 427/425; 118/315; 118/320; 118/321; 216/94

[58] Field of Search ..... 427/286, 424, 427/425, 555, 556, 596; 118/313, 314, 315, 320, 321; 216/65, 94; 219/121.76, 121.77, 121.68, 121.69, 121.8

[56] References Cited

U.S. PATENT DOCUMENTS

| | | | |
|---|---|---|---|
| 5,373,137 | 12/1994 | McLaughlin | 219/121.68 |
| 5,645,895 | 7/1997 | Murayama et al. | 427/424 |
| 5,662,968 | 9/1997 | Yamaguchi | 427/424 |
| 5,707,689 | 1/1998 | Hori | 427/424 |

FOREIGN PATENT DOCUMENTS

| | | |
|---|---|---|
| 422560 | 10/1936 | Belgium . |
| 0056704A2 | 7/1982 | European Pat. Off. . |
| 0765694A1 | 4/1997 | European Pat. Off. . |
| 2641717 | 7/1990 | France . |
| 2804539 | 2/1978 | Germany . |
| 687742A5 | 2/1997 | Switzerland . |
| 2282771 | 4/1995 | United Kingdom . |

*Primary Examiner*—Shrive Beck
*Assistant Examiner*—Kirsten A. Crockford
*Attorney, Agent, or Firm*—Birch, Stewart, Kolasch & Birch, LLP

[57] ABSTRACT

A method of applying a pattern to a surface of a substrate includes forming mutually parallel pattern rows applied by at least two output channels. In order to produce a pattern without strip-like visible faults, provision is made for the output channels in each case to be displaced transversely in relation to the pattern rows such that pattern rows can optionally be applied by at least some of the output channels in order to obtain a complete pattern. The individual pattern rows are applied by different output channels and are mixed with one another.

13 Claims, 2 Drawing Sheets

METHOD OF APPLYING A PATTERN TO A SURFACE OF A SUBSTRATE

BACKGROUND OF THE INVENTION

1. Field of Invention

The invention relates to a method of applying a pattern to a surface of a substrate. In this method, mutually parallel pattern rows are applied by at least two output channels.

2. Description of Background Art

Methods for applying a pattern are used, inter alia, during the production of printing stencils. In this case, for example during the production of a cylindrical flexographic printing plate, an opaque covering liquid is sprayed onto the photosensitive elastomeric layer of a blank with the aid of spray nozzles, which form the output channels. The spray nozzles are driven by a central computing unit such that the covering liquid is sprayed on in accordance with the pattern to be produced.

To apply a surface-covering pattern in the conventional method, a spray head which has a number of spray nozzles is used where a large number of pattern rows which are located immediately alongside one another are produced by each spray nozzle, starting from a first position. The spray head is respectively displaced by one pattern row spacing. In each case, during the application of a pattern row or thereafter, until the last pattern row sprayed on by a specific spray nozzle is located immediately alongside the first pattern row of the next spray nozzle in the direction of displacement, the spray head is displaced. In this way, a pattern section is produced whose width in the direction of displacement is equal to the product of the distance of the spray nozzles from one another and the number of spray nozzles. This pattern section is composed of a large number of pattern strips, corresponding to the number of spray nozzles, each strip being formed from a large number of pattern rows which have all been produced by one and the same spray nozzle.

After a pattern section has been applied, the spray head is displaced by the distance between the first and last spray nozzles in order to produce the next pattern section in the manner described.

However, since the individual spray nozzles in the spray heads are not identical and since, therefore, the size and velocity of the drops sprayed and/or the spraying direction may fluctuate, for example within specific tolerance limits, each pattern row produced by a spray nozzle exhibits properties which are different from those of a pattern row which was produced by another spray nozzle. However, since all of the pattern rows of one pattern strip are produced by one and the same spray nozzle, they should also have the corresponding characteristic, which is more clearly visible as a result of this repetition.

In particular, fluctuations in the size of the drops sprayed by the individual spray nozzles have a noticeably disturbing effect as fluctuations in the grey value, for example in the case of screened continuous-tone patterns.

The result is, in particular, a striation of the pattern in the direction of the pattern rows, that is to say, in the case of a pattern applied in the circumferential direction to a cylinder, in the circumferential direction of the cylinder.

The connecting point between the individual pattern sections is particularly problematic, since in the case of spray heads having a number of spray nozzles, the differences between the individual nozzles are such that, although they are not very great from one spray nozzle to the next one, they become greater from one end of the spray head towards the other. Thus, the difference between the first and last spray nozzle is typically the greatest. Since, in the connecting region of the pattern sections, the pattern strip produced by the first spray nozzle immediately abuts a pattern strip produced by the last spray nozzle, the differences are particularly clearly noticeable at this location.

This problem becomes particularly clear in the case where a spray nozzle fails completely and does not produce a pattern strip. In the case of a typical spray-nozzle spacing of about 1 mm, the pattern then has pattern-free strips at regular intervals and, at 1 mm wide, these strips stand out clearly.

The problems described occur not only in the case of spray nozzles for applying covering liquids or the like, but also in the case of other output channels which operate with laser light, for example, in order either to expose a photosensitive layer in accordance with a pattern or to remove a varnish layer or the like in accordance with a pattern by means of evaporation or the like.

SUMMARY OF THE INVENTION

The object of the present invention is to provide a method of applying a pattern to a surface of a substrate where patterns without visible faults may be produced.

According to the invention, therefore, provision is made for the output channels and the pattern rows in each case to be displaced relative to one another in their transverse direction such that pattern rows can optionally be applied by at least some of the output channels. As a result, a complete pattern in which the individual pattern rows applied is obtained by different output channels that are mixed with one another, and optionally located alongside one another.

In this way, it is possible to apply a pattern row by row to the surface of a substrate without the pattern rows which are all produced by the same output channel being located alongside one another. It is thus possible to prevent pattern strips whose individual pattern rows exhibit the same fault-induced or tolerance-induced deviation from pattern rows from other output channels. Even if, for example, one output channel applies pattern rows with a reduced contrast as a result of fault-induced or tolerance-induced deviations from its desired properties as a result of applying a covering liquid with a reduced drop size, this hardly stands out in the overall pattern, since in each case only one or at most a few pattern rows, come to lie between pattern rows which were produced by other output channels. In this case, different output channels are preferably used for the pattern rows which are located alongside to the left and right directions.

In this way, any deviations of individual pattern rows from their desired properties or from adjacent pattern rows are completely lost in the overall pattern, since they can no longer be perceived, at least by the human eye.

Using the method according to the invention, it is therefore possible to apply a visibly fault-free pattern to a surface of a substrate, even if the properties of the individual output channels deviate from one another because of faults or tolerances. Even if an output channel fails completely when a pattern is being applied, it is nevertheless possible to produce a useable pattern, since the lack of individual pattern rows, which are typically about 0.10–0.03 mm wide, hardly stand out at all in the complete pattern.

It is particularly advantageous if the output channels are displaced together by one pattern row spacing or a multiple thereof, but at most by the distance between the first and the last output channel, as measured in the direction of displacement. The output channels in each case are then displaced together by the same distance. In this case, any desired pattern rows may be produced in each case in any position of the output channels in relation to the substrate. It is therefore possible, on the basis of the stored pattern data, the position of an output channel and the pattern rows already produced, to determine whether the output channel being considered should or should not produce a pattern row in this position. No pattern row is applied by the output channel being considered if the pattern row has already been applied in the desired form or if a control program for applying the patterns decides that the pattern row in question will be produced later by another output channel.

In order to achieve the simplest possible control of the output channels and, at the same time, to apply the pattern as rapidly as possible, the invention provides for the forward displacement to be preferably equal to the product of the pattern row spacing and the number of output channels, in each case pattern rows being applied by all the output channels located over the area of the pattern.

In principle, the pattern rows can also be applied to a circularly cylindrical surface in the cylinder longitudinal direction while the cylindrical substrate is stationary. In each case, after a set of pattern rows has been applied, the substrate is rotated in order to produce the forward displacement.

An advantageous refinement of the invention is distinguished by the fact that the pattern rows are applied to a circularly cylindrical surface, essentially in the circumferential direction. The output channels which are arranged to be offset in relation to one another in the cylinder longitudinal direction are displaced together in the cylinder longitudinal direction. In this case, it is expedient if the output channels are kept stationary during the application of the pattern rows, and the output channels are in each case displaced after one pattern row or a group of pattern rows has been applied, before the next pattern row or the following group of pattern rows is applied.

In this way, the pattern rows may be applied in the circumferential direction to a cylindrical surface. Since the output channels are therefore kept stationary during the application of pattern rows, while the output of a pattern does not take place during the displacement of the output channels transversely in relation to the pattern rows, the control program can be configured particularly simply in this refinement of the invention.

In another refinement of the invention, the output channels are displaced continuously by the predefined distance, transversely in relation to the pattern rows, while one pattern row or a group of pattern rows is being applied.

In this way, the pattern may be applied like a helical line to the cylindrically arranged surface of the substrate. The cylindrical surface to which the pattern is to be applied may, for example as in the case of cylindrical or roll-like printing plates, extend completely around the cylinder. However, it is also conceivable for an intrinsically flat but flexible substrate to be clamped onto a cylindrical roll in order to produce a pattern.

Provision is expediently made for the pattern to be applied by exposing a photosensitive layer by means of laser light. However, it is also possible for the pattern to be applied by removing, point by point, by means of laser light, a layer provided on the substrate.

The method according to the invention may be used particularly expediently if the pattern is applied by spraying on a covering liquid by means of spray nozzles where an opaque covering liquid is sprayed onto a photosensitive layer.

Another refinement of the invention is that an electrically insulating covering liquid is sprayed onto a continuous conductive surface. Furthermore, according to the invention it is possible for the substrate to be a screen, onto which there is sprayed a covering liquid. The covering liquid after drying and/or curing, is mechanically and chemically resistant to printing inks.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
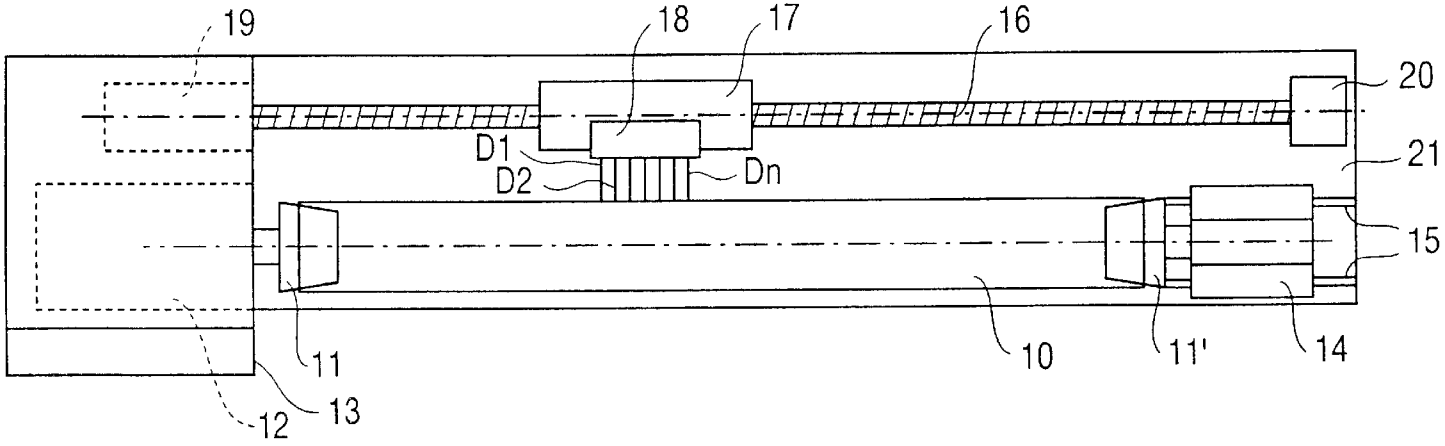
FIG. 1 shows a simplified schematic illustration of a device for applying a pattern to a cylindrical surface of a substrate, using a spray head having a large number of output channels.

In the various figures of the drawing, components which correspond to one another are provided with the same reference symbols.

The device illustrated in FIG. 1 for applying a pat tern to the surface of a cylinder 10, provided as a substrate, has two mounting cones 11, 11', between which the cylinder 10 is clamped. The mounting cone 11 on the left in FIG. 1 is connected to a main drive 12, which is arranged in an appropriate housing 13. The housing has on its front side operating elements for the device that are not shown. The other mounting cone 11' is fitted to a carriage 14, which can be displaced in a definable manner on rails 15 in the cylinder longitudinal direction in order to make it possible to clamp cylinders 10 of different lengths.

Arranged alongside the mounting cones 11, 11', parallel to the cylinder 10 and arranged between them, is a guide and drive spindle 16, referred to in brief below as a spindle, for a supporting carriage 17. On the supporting carriage 17 is the output head or spray head 18 having a large number of spray nozzles serving as output channels D1, D2, . . . Dn.

In order to make it possible to displace the spray head 18 in the cylinder longitudinal direction in a defined manner with high accuracy, one end of the spindle 16 is connected to a spindle drive 19, while its other end is supported on a machine frame 21 via a corresponding bearing block 20.

Figure 2:
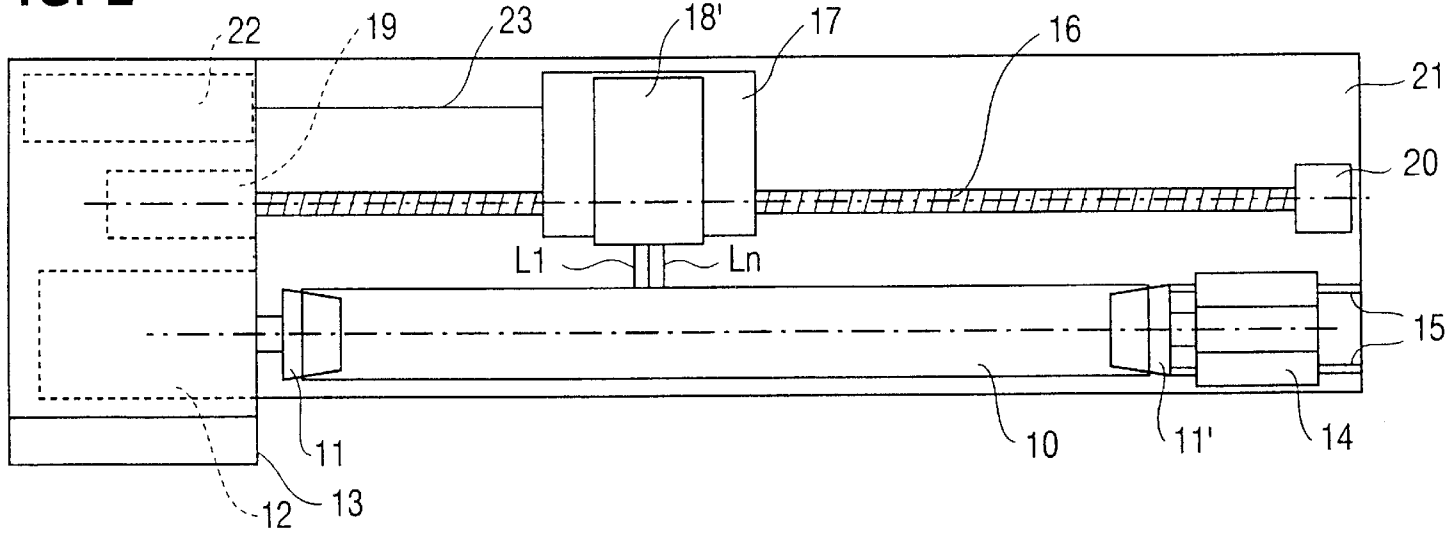
FIG. 2 shows a simplified schematic illustration of a device for applying a pattern to the cylindrical surface of a substrate, using a laser exposure device having a number of output channels.

FIG. 2 shows another device for applying a pattern to a surface of a cylinder 10, this device essentially differing from that according to FIG. 1 only in the fact that it operates with laser light instead of with a covering liquid. Accordingly, the device according to FIG. 2 has a laser 22 which is arranged in the housing 13 and which emits a laser beam 23, which is parallel to the longitudinal direction of the spindle 16, to a laser output head 18', which is arranged on the supporting carriage 17 borne by the spindle 16. The laser output head 18' has (in a way which is not specifically illustrated) splitting optics for multiplying the laser beam 23, which can be switched into a number of mutually independent beams L1 . . . Ln. The splitting optics thus comprises a number of parallel output channels by which, in each case, a laser beam L1 . . . Ln is directed onto the surface of the cylinder 10 in order to apply a pattern to this surface.

Figure 3:
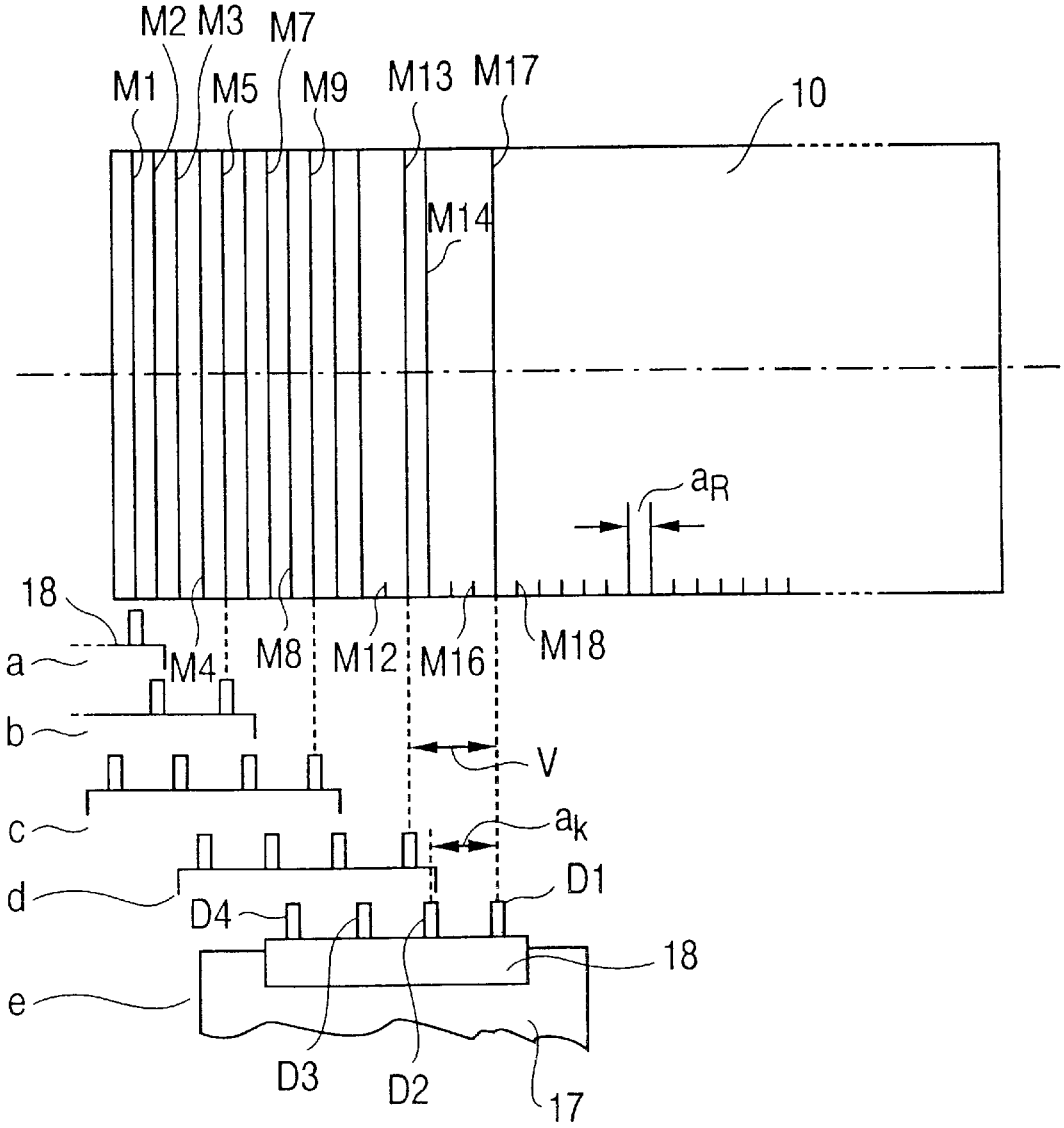
FIG. 3 shows a schematic illustration of a cylindrical area of a substrate with pattern rows indicated thereon, and an associated output head in various positions for applying the pattern rows.

Implementing the method according to the invention using the device illustrated in FIG. 1 will be explained in more detail below with reference to FIG. 3. For reasons of simplicity, the spray head 18 is illustrated in FIG. 3 only with four spray nozzles D1, D2, D3, D4 serving as output channels.

In order to apply a pattern to the surface of the cylinder 10 which, for example, may be a blank for a flexographic printing plate or a hollow metallic cylinder for the electrodeposition of a screen for a printing plate, an opaque or electrically insulating covering liquid is sprayed onto the cylinder 10 in accordance with the pattern via the nozzles D1 to D4. At the same time, the cylinder 10 is rotated about its longitudinal axis at a precisely defined speed via the main drive.

After the spray head 18 has been brought into position labeled a, the first pattern row Ml is applied by the nozzle D1. The covering liquid is sprayed on in accordance with the individual pattern points of the pattern row. While the first pattern row Ml is being applied with the aid of the nozzle D1, the other nozzles D2 to D4 are switched off.

As soon as the first pattern row Ml has been applied, the spray head 18 is displaced by the forward displacement V from the position labeled a into the position labeled b, in which the first two nozzles D1 and D2 are located above the area to be provided with the pattern. The forward displacement labeled V, the distance between the positions a and b by which the spray head 18 is displaced, is equal to the product of the spacing $a_R$ between the individual pattern rows Mi and the number $n_K$ of output channels, that is to say the number of spray nozzles in the present case. The following equation therefore applies to the forward displacement: $V=n_K \times a_R$ In this case, the spacing between the individual spray nozzles D1 to D4 is preferably smaller than the forward displacement by a whole multiple, including 1, of the pattern row spacing $a_R$. This condition is expedient, in particular, when a large number of output channels, for example fifty, one~hundred or more, is provided on one output head.

However, in the case of a smaller number of channels and a relatively large channel spacing, as a result of the design, the forward displacement is considerably smaller than the channel spacing. For example, in the case of three output channels ($n_K$=3) with a channel spacing of $a_K$=2 mm and a pattern row spacing of $a_R$=25 $\mu$m, the result is a forward displacement of $V=n_K \times a_R=75\ \mu m<a_K=2$ mm.

In the example illustrated, the spacing $a_K$ of the nozzles from one another in the cylinder longitudinal direction is smaller by one pattern row spacing $a_R$ than the forward displacement V. Hence, the two pattern rows M2 and M5 are applied in the position labeled b of the spray head 18. The spray head 18 is subsequently displaced into the position c, in which the pattern rows M9, M6 and M3 are produced by the spray nozzles D1, D2 and D3, respectively, while spray nozzle D4 is still switched off. In position d, the pattern rows M13, M10, M7 and M4 are then applied by means of the nozzles D1, D2, D3 and D4, respectively.

The continuous lines in FIG. 3 thus represent pattern rows which have already been applied and illustrate the situation following the application of the pattern rows Mi in the position labeled e of the spray head 18, and before the latter is displaced into the next position. In the following position, the lines M12, M15, M18 and M21 are then produced. It can therefore be seen that the individual pattern rows Mi are in each case located between two pattern rows M(i−l), M(i+l) which were produced by other spray nozzles Di.

In the above-described application of the individual pattern rows Mi, it was assumed that the spray head 18 is kept stationary in the axial direction of the cylinder 10 during the application of the pattern rows, and that no application of covering liquid takes place while the spray head 18 is being displaced in the axial direction into the respective next position. The pattern rows Mi constitute circumferential lines on the cylinder 10 which, if the area to be provided with the pattern extends completely around the cylinder 10, are likewise self-contained.

However, it is also possible, while the covering liquid is being sprayed on, to displace the spray head 18 such that it executes the necessary forward displacement $V=n_K \times a_R$ in each case during one revolution of the cylinder 10. In this case, the pattern rows Mi result in a large number of helices located alongside one another.

These procedures may be used to apply a pattern not only to a cylinder but also to a flat substrate.

In the case of a flat substrate, in which, for example, the output channels are arranged alongside one another in the x direction, while the individual pattern rows are applied in the y direction, the output channels may be displaced over the flat substrate in the y direction, while their position in the x direction is maintained. As soon as one end of the pattern has been reached, as viewed in the y direction, the output channels are then displaced, preferably in the x direction in the manner predefined by the control program, in order then to produce the next pattern rows during the displacement back to the initial side. The pattern may be applied particularly rapidly in this way, since the total displacement travel for the output channels is barely greater than the total length of the pattern rows to be applied by one output channel.

The above-described functioning of the method according to the invention is always the same during the application of a pattern to a substrate, irrespective of whether operations are carried out with a covering liquid, with laser light for exposing or removing layers or with other means which structure a surface in a suitable way.

The relationships explained using FIG. 3 between the forward displacement V, the pattern row spacing $a_R$, the spacing $a_K$ of the spray nozzles Di, that is to say of the output channels, and the number of channels $n_K$ are illustrated as a preferred example, but are not absolutely necessary.

On the basis of the pattern-point size which can be achieved by the output channels which are available, a practical resolution and a practical pattern row spacing are defined for a specific pattern, taking into account their quality and the desired output capacity. However, attention should be paid to the fact that a specific relationship between the number $n_K$ of output channels and the pattern row spacing $a_R$ must be maintained in order to be able to use the method according to the invention. Since, in the case of a specific output head, the spacing $a_K$ between the individual output channels transversely in relation to the pattern rows Mi is generally a variable which cannot be changed, it is possible to vary only the pattern row spacing $a_R$ and the number $n_K$ of output channels used. In this case, the possible pattern row spacing $a_R$ are given as the quotient of the channel spacing $a_K$ and a whole number, that is to say, therefore, $a_R=a_K/n$, where n is a whole number. Here, n preferably satisfies the condition $n=n_K \times m-1$, where m is likewise a whole number.

Whilst complying with the abovementioned conditions, it is therefore possible, given a predefined channel spacing $a_K$, for the pattern row spacing $a_R$, that is to say the resolution $1/a_R$ of the pattern in the direction transverse to the pattern rows, and the number of active output channels $n_K$, to be varied in order to be adapted optimally to the desired pattern.

However, if the channel spacing $a_K$ may be varied, it is then possible for the pattern row spacing $a_R$ to be predefined in accordance with the respective requirements. The channel spacing $a_K$ is then a whole-number multiple of the pattern row spacing.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A method for applying a pattern of substantially parallel pattern rows to a surface of a substrate with a plurality of three or more output channels, comprising the steps of:

forming said parallel pattern rows on the substrate by activating said plurality of output channels, each output channel being spaced from a neighboring output channel by a fixed distance;

calculating a displacement value as a function of at least one of said fixed distance, a distance between neighboring parallel pattern rows, and a distance between a first output channel and a last output channel; and then displacing the plurality of output channels according to said displacement value after completion of a set of pattern rows;

such that every two neighboring parallel pattern rows are generated by a first neighboring output channel being activated prior to a displacement and a second neighboring output channel being activated subsequent to a displacement; and such that, during initial stages of pattern formation, one output channel is activated during formation of a first set of pattern rows, and one additional output channel is activated during formation of each subsequent set of pattern rows until all required output channels have been activated; and performing a relative movement between said substrate and said plurality of output channels during said activation step in a direction non-parallel to the direction of the displacement.

2. The method of claim 1, wherein said displacement calculating step further comprises the step of calculating the displacement value according to one of pattern row spacing or a multiple thereof, said displacement value output channel and the last output channel.

3. The method of claim 1, wherein said displacement calculating step further comprises the step of calculating the displacement value according to a product of a spacing between the pattern rows and a number of the output channels.

4. The method of claim 1, wherein said step of forming substantially parallel pattern rows on the substrate further comprises forming substantially parallel pattern rows on a substantially cylindrical substrate.

5. The method of claim 4, wherein said step of forming substantially parallel pattern rows on the substrate further comprises maintaining the plurality of output channels in a stationary manner during pattern formation.

6. The method of claim 4, wherein said step of forming substantially parallel pattern rows on the substrate further comprises moving the plurality of output channels during formation of the pattern rows while simultaneously rotating said cylindrical substrate.

7. The method of claim 1, wherein said step of forming substantially parallel pattern rows on the substrate further comprises forming substantially parallel pattern rows with a plurality of laser light output channels on a substrate having a photosensitive layer.

8. The method of claim 1, wherein said step of forming substantially parallel pattern rows on the substrate further comprises forming substantially parallel pattern rows by removing a layer on the substrate with a plurality of laser light output channels.

9. The method of claim 1, wherein said step of forming substantially parallel pattern rows on the substrate further comprises forming substantially parallel pattern rows with a plurality of spray nozzle output channels.

10. The method of claim 9, wherein said step of forming substantially parallel pattern rows on the substrate further comprises spraying an opaque covering liquid with said spray nozzle output channels onto said substrate, said substrate having a photosensitive layer.

11. The method of claim 9, wherein said of forming substantially parallel pattern rows on the substrate further comprises spraying an electrical insulating covering liquid on to a continuous conductive surface disposed on said substrate.

12. The method of claim 9, wherein said step of forming substantially parallel pattern rows on the substrate further comprises spraying a covering liquid with said spray nozzle output channels on to a screen substrate.

13. A method for applying a pattern of substantially parallel pattern rows to a surface of a substrate, with a plurality of three or more output channels, such that each pattern row is generated by a different output channel from its adjacent pattern rows, comprising the steps of:

forming said parallel pattern rows on the substrate by activating said plurality of output channels, each output channel being spaced from a neighboring output channel by a fixed distance, said fixed distance being greater than a distance between said parallel pattern rows;

calculating a displacement value of a product of said distance between pattern rows and a number of the output channels; and then displacing the plurality of output channels according to said displacement value after completion of a set of pattern rows;

such that, during initial stages of pattern formation, one output channel is activated during formation of a first set of pattern rows, and one additional output channel is activated during formation of each subsequent set of pattern rows until all required output channels have been activated; and performing a relative movement between said substrate and said plurality of output channels during said activation step in a direction non-parallel to the direction of the displacement.

* * * * *